US005526777A

United States Patent [19]

Taomo et al.

[11] Patent Number: 5,526,777

[45] Date of Patent: Jun. 18, 1996

[54] AIR INLET APPARATUS FOR INTERNAL COMBUSTION ENGINE

[75] Inventors: Toshio Taomo; Hiroaki Koga; Yoshiaki Nagao; Hiroji Kawasaki; Tsutomu Ogata, all of Ohme, Japan

[73] Assignee: Kioritz Corporation, Tokyo, Japan

[21] Appl. No.: 319,115

[22] Filed: Oct. 6, 1994

[30] Foreign Application Priority Data

Oct. 6, 1993 [JP] Japan ..... 5-059257 U

[51] Int. Cl.[6] ..... F01P 1/02

[52] U.S. Cl. ..... 123/41.65; 123/198 E; 55/437; 55/DIG. 14; 55/DIG. 28

[58] Field of Search ..... 123/41.56, 41.65, 123/41.7, 198 E; 55/337, 357, 392, 437, 473, DIG. 14, DIG. 28

[56] References Cited

U.S. PATENT DOCUMENTS 4,261,302 4/1981 Sheldon ..... 123/41.65

5,367,988 11/1994 Collins ..... 123/41.65

*Primary Examiner*—Noah P. Kamen

*Attorney, Agent, or Firm*—Bauer & Schaffer

[57] ABSTRACT

An air path is provided in the main body of a chain saw so as to connect an air inlet port provided on the main body and a carburetor chamber of the internal combustion engine and also connected to a cooling fan chamber. For use under normal conditions, combustion air is taken from the air inlet port into the carburetor chamber. In case of a rainy or snowy day, the air inlet port is closed and combustion air is taken from the cooling chamber into the carburetor chamber, air control means is provided between the air path and the cooling fan chamber. This air control means generates stagnation of air flow in the cooling chamber in order to supply air into the carburetor chamber and prevent dust and the like from being taken into the air path.

3 Claims, 5 Drawing Sheets

AIR INLET APPARATUS FOR INTERNAL COMBUSTION ENGINE

FIELD OF THE INVENTION

This invention relates to an air inlet apparatus for internal combustion engines.

BACKGROUND OF THE INVENTION

A conventional chain saw has an internal combustion engine such as an air cooled two-cycle gasoline engine as a power source. The inventors'previously proposed air inlet apparatus for an internal combustion engine of this type having the construction (Japanese Patent Application Laid Open No. 195891/-1993) where an air inlet port is provided on the upper part of the main body of the machine, and an air path is provided inside the main body so as to allow the air flowing from the air inlet port to flow onto the upper part of the engine and then downwardly using the intake manifold pressure generated by a cooling fan chamber of the engine. A filter is provided in the air path so that the surface of the filter through which air supplied to the carburetor chamber passes faces to the inner wall of the air path. The air flow into the carburetor chamber intersects the surface of the filter.

According to this air inlet apparatus, any dust contained in the air is removed by the filter and the dust accumulated on the surface of the filter are blown down along the surface of the filter by the air passing in the air path from the top downwardly. Therefore, clogging of the filter is avoided and high filtration performance of the filter can be maintained.

However, as the air inlet port is provided on the upper part of the main body of the chain saw, there were cases where the air inlet port was covered by snow during outdoor work in the winter and the filter frozen inside the main body by water invading the engine from the air inlet port. During operation in the rain during the summer, water also interfered with the filter function, as water invaded the air inlet port resulting in failure of the internal combustion engine.

SUMMARY OF THE INVENTION

The object of the present invention is to provide an air inlet apparatus for internal combustion engines, which can be used in all seasons by being capable of selectively changing the direction in which air is fed from the inlet port to the carburetor chamber.

The air inlet apparatus for internal combustion engines according to the present invention is constructed as follows:

An air path connecting a carburetor chamber of an internal combustion engine provided inside the main body of the working machine communicates with an air inlet port provided on the main body, wherein the air path is connecting between the carburetor chamber and the inlet side of a cooling fan chamber. Between this air path and the carburetor chamber, a filter is provided to purify air supplied into the carburetor chamber is provided. An air path opening and closing means is provided on upstream of the filter to open and close the air path.

Further, air control means provided with a closing plate and a guide plate having the following construction are provided.

The closing plate having an air hole is provided on a connecting part between the air path and the cooling fan chamber so as to intersect each other. The guide plate is fixed to the closing plate at the base thereof and formed so as to gradually extend from the closing plate and come near to the tip side thereof. Between the tip side of the guide plate and the closing plate, an open space is formed so as to connect to the air hole, while opened to the rotating direction of the cooling fan inside the cooling fan chamber.

According to the present invention constructed as aforementioned, air is supplied usually from the air inlet port into the carburetor chamber.

The air path is occluded at the upstream of the filter near to the air inlet port by the air path opening and closing means, according to working conditions such as rain and snowfall. Therefore, problems such as wetting of the filter with water or snow invading from the air inlet port is avoided.

Once the air inlet port is closed, air flow into the carburetor chamber takes place from the cooling fan chamber instead of air flow from the air inlet port.

While the cooling fan is rotating, inlet air flow is generated along the rotating direction of the cooling fan at the inlet side of the cooling fan chamber. This air flow is intercepted by the guide plate and led toward the tip part thereof. Therefore, air stagnation occurs at the open space of the air control means. This stagnant air is led to the carburetor chamber, sequentially passing through the air hole of the closing plate, the air path, the filter by the intake manifold pressure generated in the carburetor chamber during intake stroke of the internal combustion engine. Because air at the open space is stagnant by the effect of the guide plate, air intake of the carburetor chamber is never inhibited.

Further, dust and the like taken into the cooling fan chamber together with air are led toward the blast direction of the cooling fan by the guide plate. Therefore, dust and the like are never taken into the air path through the air hole.

DETAILED DESCRIPTION OF THE INVENTION

Figure 1:
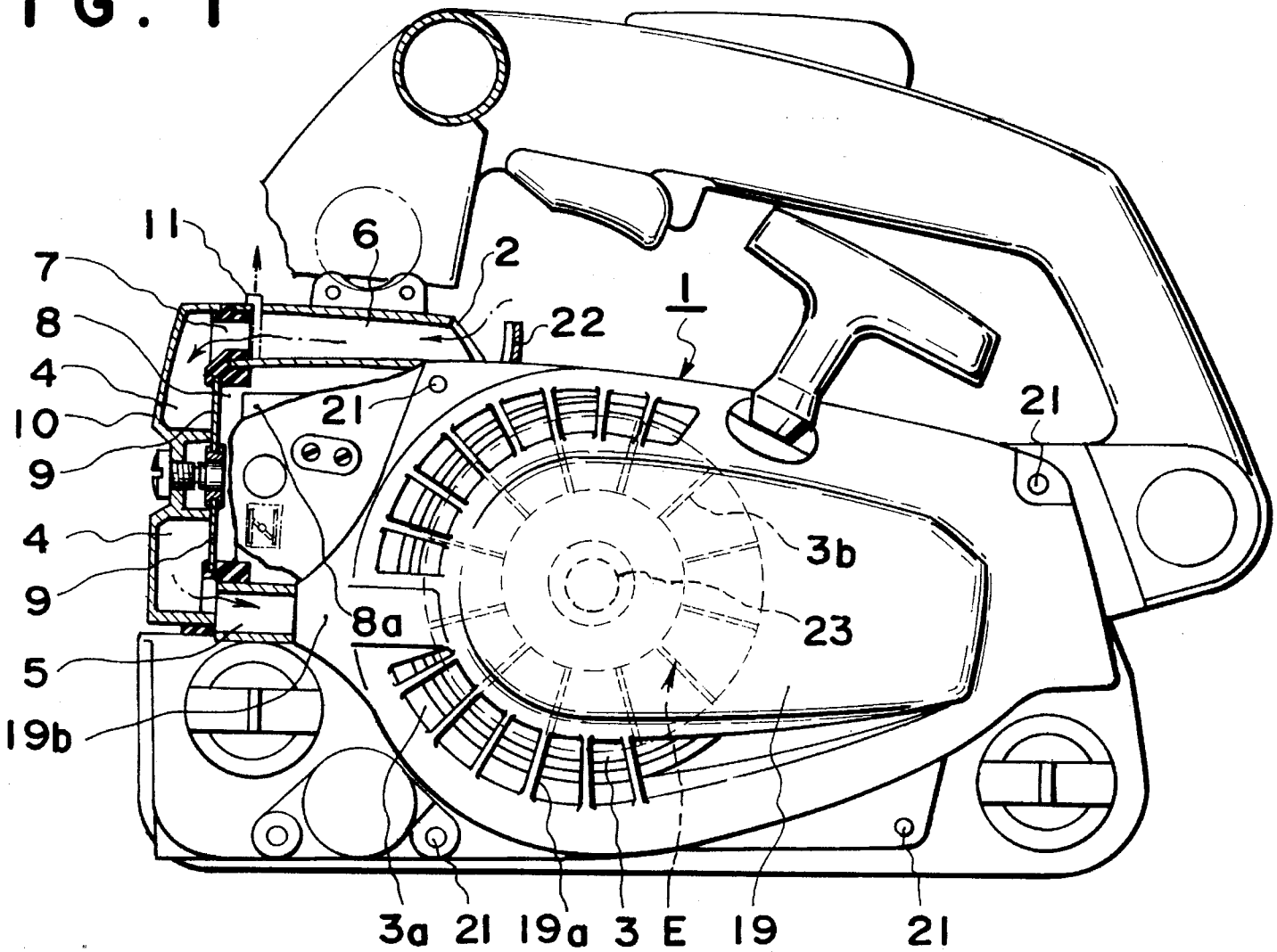
FIG. 1 is a partially sectional side view showing one embodiment of the present invention applied to an internal combustion engine of a chain saw.

Inside the main body 1 of a chain saw, an air cooled two-cycle gasoline engine E is housed. Adjacent to this engine E there is provided a carburetor chamber 8 accommodating a carburetor 8*a* therein and a cooling fan chamber 3 in which is housed a fan 3*b*.

This cooling fan 3*b* is fixed to the crank shaft 23 of the engine E and is covered by a fan cover 19 installed on one side of the main body 1 of the chain saw. The fan cover 19 and one side of the main body 1 define the cooling fan chamber 3. 0n the fan cover 19, many air inlet slits 19a are provided in order to take cooling air into the cooling fan chamber 3. On each of the four corners of the fan cover 19, holes 21 are provided to fix the cover to the body. The fan cover 19 can be freely attached on or removed from the side face of the main body 1 of the chain saw through bolts (not shown in the drawings) inserted into these fixing holes 21.

On the upper part of the main body 1 there is provided an air inlet port 2 opening rearwardly and forming an upper air path 6 extending horizontally forward into the main body 1. This upper air path 6 is connected to an air intake silencer 7 with an appropriate number of noise suppressing tubes. This air intake silencer 7 communicates with the upper part of the first air path 4 extending downward on the front part inside the main body 1. The lower part of this first air path 4 communicates with a second air path 5 extending backward inside the main body 1 and which leads to the inlet side 3a of the cooling fan chamber 3 via an extruded part 19*b* of the cover 19. The part 9*b* is U-shaped in sectional view and formed so as to comprise the terminal side part of the second air path 5 between one side of the main body 1 of the chain saw.

The first air path 4 extends upward and downward along the surface of a filter 9. Behind this filter 9 there is located an airtight carburetor chamber 8 in the main body 1. The filter 9 is in the form of a plate connected to the air intake silencer 7 on one side so as to clean the air taken from the air inlet port 2 and supplying the air to the upstream of the carburetor chamber 8.

In the construction as aforementioned, intake manifold pressure (negative pressure) is generated in the cooling fan chamber 3 once the cooling fan 3*b* is rotated by the engine E. By this intake manifold pressure, outside air is taken into the cooling fan chamber 3, as cooling air, from the air intake slits 19a provided on the fan cover 19. At the same time, outside air is taken into the main body 1 from the air inlet port 2 by the intake manifold pressure generated in the cooling fan chamber 3, a part of which air is taken into the main body 1 through the first air path 4. This air then reaches to the inlet side 3A of the cooling fan chamber 3, as a part of cooling air for the engine E, through the second air path 5.

The remaining part of air taken into the main body 1 from the air inlet port 2 is taken into the carburetor chamber 8, as combustion air, from the first air path 4 by the intake manifold pressure (negative pressure) in the carburetor chamber 8. Air supplied to the carburetor chamber 8 flows through the filter 9 so that dust and the like contained in the air are removed by the filter 9.

Inside the first air path 4, air flows from the top downwardly along the surface of the filter 9 in response to the intake manifold pressure generated in the cooling fan chamber 3 as mentioned above. Therefore, dust and the like removed from the air by the filter fall down from the surface of the filter 9 by the downward air flow. Thereby clogging of the filter 9 is avoided and air filtration performance maintained.

According to the present invention, the air path connecting the outside to the inside of the main body 1 of the chain saw can be closed freely at the upstream side of the filter 9 (between the filter 9 and the air inlet port 2). Examples of air path opening and closing means which can be utilized are as follows:

The first method is to close the air inlet port 2 with adhesive tape.

The second method is to remove a carburetor chamber cover 10 which serves as a fixing part of the filter 9 as well and to plug the air intake silencer 7 and secure the cover 10 again.

The third method is to provide the main body 1 with a shutter 11, operable from the outside to open and close the upper air path 6.

By intercepting the air path connecting the outside and inside of the main body 1 of the chain saw at the upstream of the filter 9 as mentioned above, water never reaches to the filter 9. Therefore, the filter 9 can be protected from wetting.

When the air path conducting air from the outside to the inside of the main body 1 of the chain saw is closed at the upstream of the liter 9, combustion air intake into the carburetor chamber 8 can be made from the cooling fan chamber 3 through the second air path 5 and the first air path 4.

However, combustion air intake directly from the cooling fan chamber 3 may create the following problems:

Firstly, intake manifold pressure at the cooling fan chamber 3 generated by rotation of the cooling fan 3*b* may become larger than intake manifold pressure at the engine E (intake manifold pressure generated in the carburetor chamber 8 during intake stroke of the engine E), resulting in reduction of efficient air supply into the carburetor chamber 8.

Secondly, large amounts of dust and the like may be taken into the carburetor chamber 8 from the cooling fan chamber 3, resulting in clogging of the filter 9 since saw dust, oil mist, sand and others can be easily taken into the cooling fan chamber 3 through the air inlet slits 19*a* by intake manifold pressure in the cooling fan chamber 3.

Figure 4:
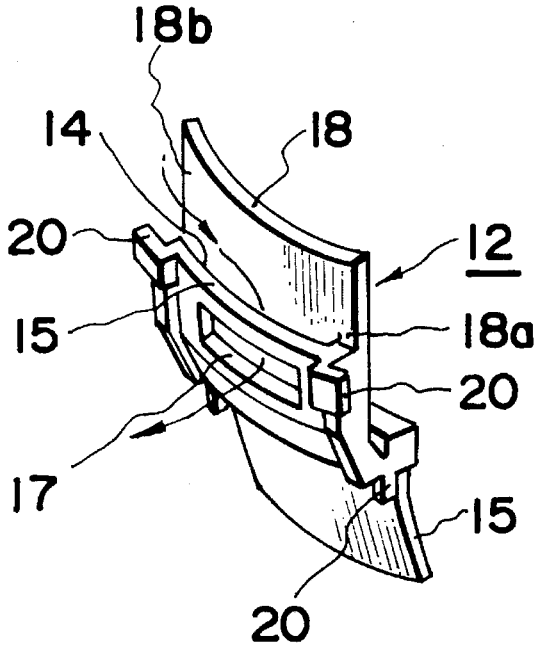
FIG. 4 is a perspective view of an air control means.
Figure 5:
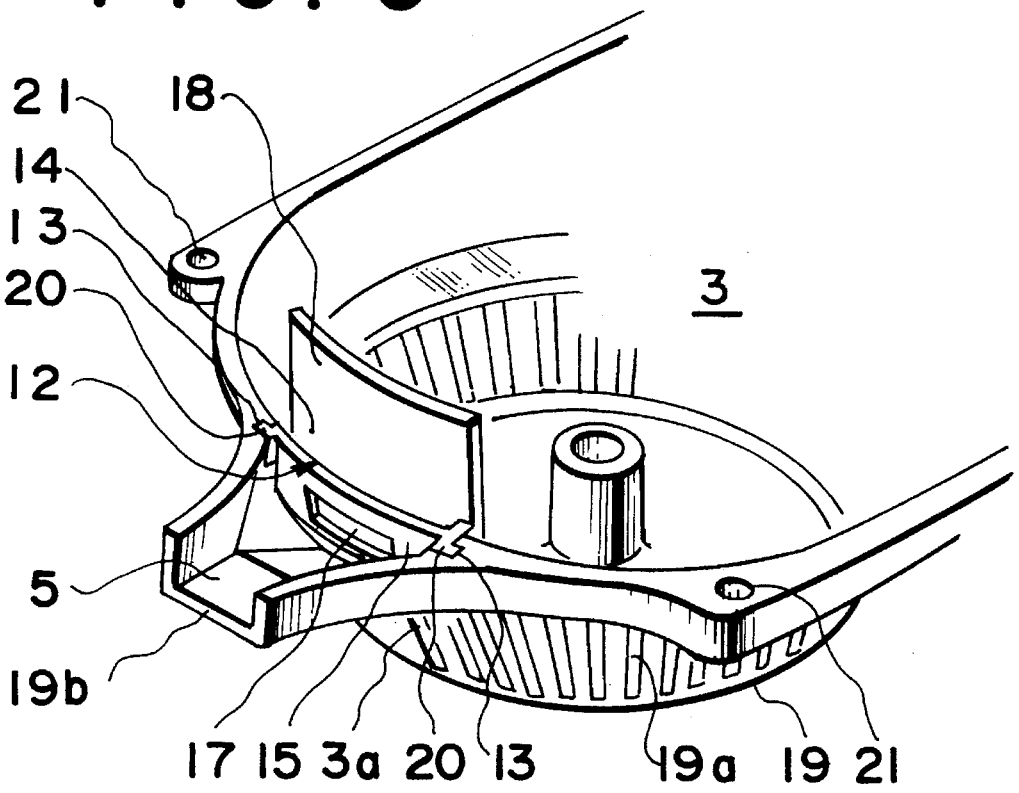
FIG. 5 is an exploded perspective view showing the status of an air control means attached to a cooling fan cover.
Figure 6:
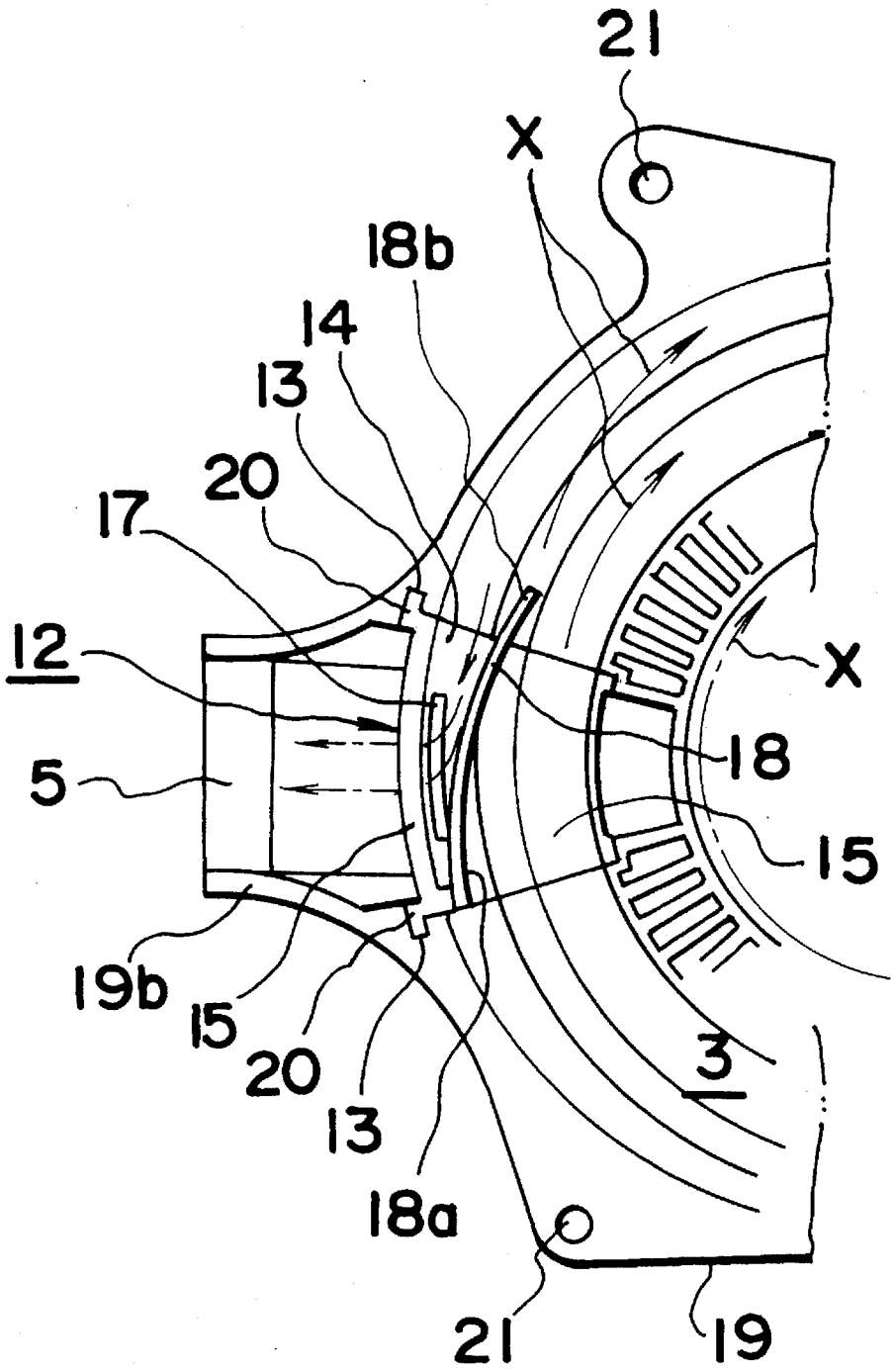
FIG. 6 is a plan view of FIG. 5.

In order to resolve the aforementioned problems according to the present invention, an air control means 12, as shown in FIGS. 4–6, is provided between the cooling fan chamber 3 and the second air path 5 so as to be freely attachable and removable. This air control means 12 can be used during work in rain and snowfall.

The air control means 12 is provided with a closing plate 15 capable of intercepting the air path between the second air path 5 and the inlet side 3a of the cooling fan chamber 3. The closing plate 15 has an air hole 17 which is the predetermined area ratio against the second air path 5.

The air control means 12 is also provided with a guide plate 18 on the side of the closing plate 15 facing the cooling fan chamber 3. This guide plate 18 is fixed to one edge of the closing plate 15 by a base part 18*a* thereof. The guide plate 18 is curved so as to gradually extend from the closing plate 15 and to come close to the center part of the fan cover 19 to reach to the end 18*b* thereof. Therefore, a V-shape is formed by the guide plate 18 and the closing plate as shown in FIG. 6, and an open space 14 is formed between the end 18*b* of the guide plate 18 and the closing plate 15. This open space 14 is located at the side of rotating direction of the cooling fan 3*b* (indicated by arrow x in FIG. 6). The open space 14 is open to said air hole 17 provided on the closing plate 15. The guide plate 18 is extending toward the rotating direction of the cooling fan 3*b* than the closing plate 15 and also extending toward the main body 1 of the chain saw than the closing plate 15. The guide plate 18 has the following functions:

Firstly, it prevents air flow generated by rotation of the cooling fan 3*b* taking into the second air path 5.

Secondly, it prevents dust and the like from being taken into the cooling fan chamber 3 together with air into the second air path 5.

Thirdly, it leads air flow generated by rotation of the cooling fan 3*b* toward the blast direction X of the cooling fan 3*b* and allows the formation of air stagnation in the open space 14.

Fourthly, when the fan cover 19 is installed on the main body 1 of the chain saw, the extending part forming the closing plate 5 fits to the main body 1.

Once the cooling fan 3*b* is rotated, intake air flow toward the rotating direction of the cooling fan 3*b* is generated at the inlet side 3a of the cooling fan chamber 3. This air flow is disturbed by the guide plate 18 and led toward the tip part 18*b* thereof. Therefore, air stagnation occurs at the open space 14. This stagnant air is led to the carburetor chamber 8 sequentially passing through the air hole 17 of the closing plate 15, the second air path 5, the first air path 4 and the filter 9 by the intake manifold pressure generated in the carburetor chamber 8 during intake stroke of the engine E. Because air at the open space 14 is stagnant by the effect of the guide plate 18, air intake of the carburetor chamber 8 is never inhibited.

Further, dust and the like taken into the cooling fan chamber 3 together with air are led toward the blast direction X of the cooling fan 3*b* by the guide plate 18. Therefore, dust and the like are never taken into the second air path 5 through the air hole 17.

On the air control means 12, fitting pieces 20 are formed. These fitting pieces 20 fit to holding grooves 13 formed on the fan cover 19. After the fan cover 19 is removed, the air control means 12 can be installed to the fan cover 19 through the fitting pieces 20. Another construction which allows installation of the air control means 12 from outside of the fan cover 19 without removing it from the main body 1 is also feasible.

In the embodiment shown in the attached drawings, for the convenience of manufacturing of the fan cover 19 the air control means 12 and the fan cover 19 were formed separately. However, the air control means 12 may be formed in one body with the fan cover 19. In this case, purified air can be supplied to the carburetor chamber 8 without any trouble regardless that air inlet port 2 is opened or closed, by appropriately designing the shape of the air hole 17, the guide plate 18 and the like.

Figure 2:
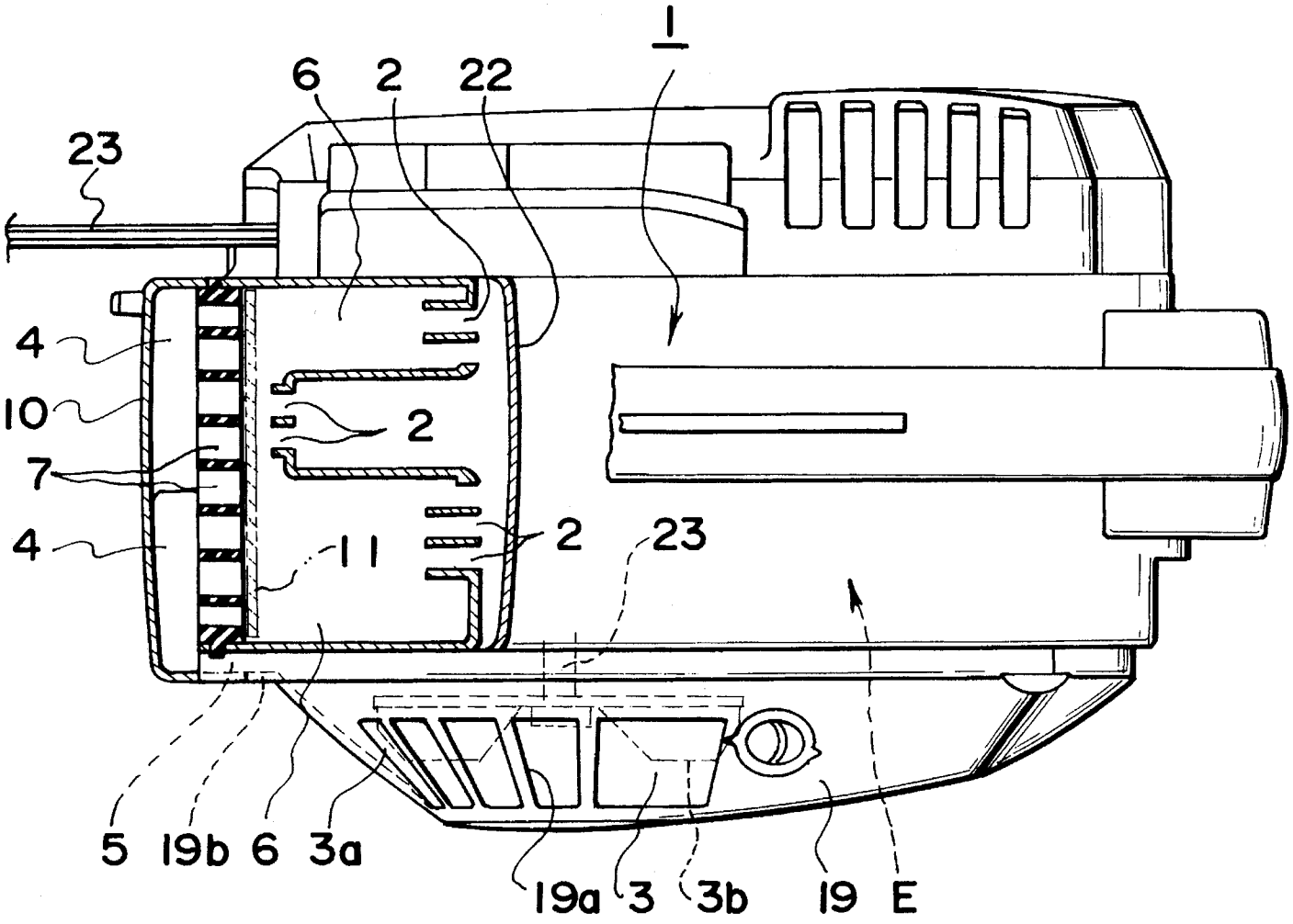
FIG. 2 is a partially sectional plane view of FIG. 1.
Figure 3:
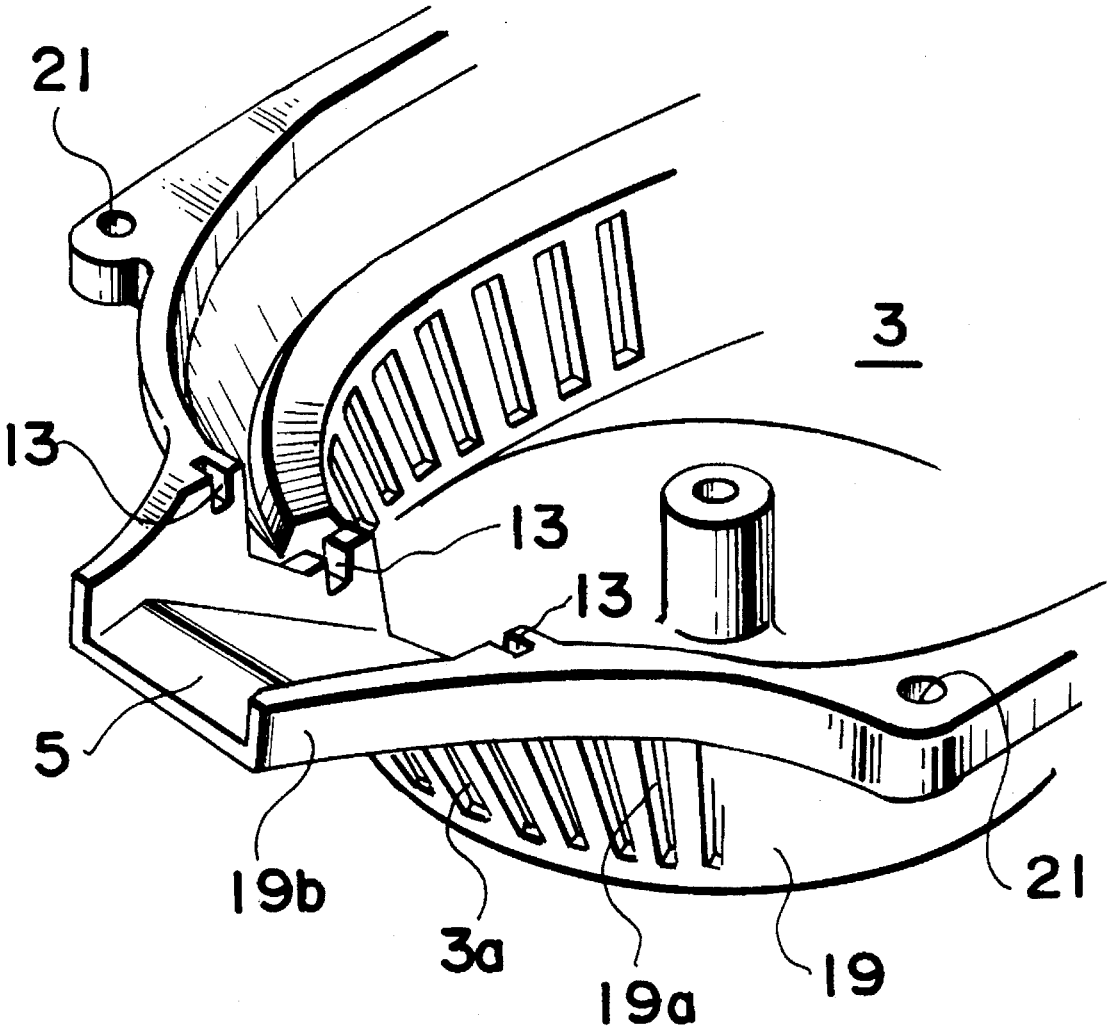
FIG. 3 is an exploded perspective view of a cooling fan cover.

Numeral 22 in FIGS. 1 and 2 is a wall preventing water flow provided on the upper part of the main body 1 of the chain saw and backward of the air inlet port 2. This wall 22 preventing water flow can prevent invasion of dust and like as well as water into the air inlet port 2.

Numeral 23 in FIG. 2 is a guide bar for a saw chain (not shown). According to the present invention constructed as aforementioned, the air inlet port supplying air to the carburetor chamber 8 can be changed according to season and weather during use of the chain saw. Therefore, it can be used without any trouble even in rain and snowfall.

The present invention can be applied not only to chain saws but also to all kinds of working machines loaded with air cooled internal combustion engines.

The present invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. In a working tool having an internal combustion engine and a main body housing a carburetor in a carburetor chamber and a cooling fan in a fan chamber comprising:

an air path communicating with the carburetor chamber, an air inlet port provided in said main body communicating with said carburetor chamber and the inlet side of said cooling fan chamber;

a filter provided between said air path and said carburetor chamber in order to purify air supplied to said carburetor chamber;

means for opening and closing said air path at the upstream side of said filter; and air control means comprising a closing plate having an air hole, said control means being provided on the part connecting said air path and said cooling fan chamber so as to occlude each thereof, a guide plate fixed to said closing plate at the base thereof and formed so as to gradually extend from said closing plate to the tip thereof having an open space between the tip part of said guide plate and said closing plate communicating with said air hole and being opened toward the rotating direction of said cooling fan in said cooling fan chamber.

2. An air inlet apparatus for an internal combustion engine comprising:

a main body defining a chamber for a cooling fan and a chamber for a carburetor;

an air inlet port provided on the upper part of the main body;

a first air path communicating with said air inlet port and extending downwardly inside said main body;

a second air path connecting said first air path an inlet side of said cooling fan chamber;

a filter provided along said first air path in order to purify air supplied to said carburetor chamber;

means provided at the upstream side of said filter in order to open and close said first air path; and air control means comprising a closing plate having an air hole and provided on the part connecting said air path and said cooling fan chamber so as to occlude each thereof, and a guide plate fixed to said closing plate at the base thereof and formed so as to gradually extend from said closing plate to the tip thereof forming an open space between said tip of said guide plate and said closing plate connected to said air hole and being opened toward the rotating direction of said cooling fan in said cooling fan chamber.

3. An air inlet apparatus described in claims 1 or 2, wherein said air control means is freely attachable to and removable from a cover forming said fan chamber.

* * * * *